US005870836A

United States Patent [19]

Grimes

[11] Patent Number: 5,870,836

[45] Date of Patent: Feb. 16, 1999

[54] PORTABLE CLOTHES DRYER

[76] Inventor: Bonnie J. Grimes, 320 Kittell Loop, Bloomfield, N. Mex. 87413

[21] Appl. No.: 677,190

[22] Filed: Jul. 9, 1996

[51] Int. Cl.[6] ..... F26B 11/18

[52] U.S. Cl. ..... 34/202; 34/218

[58] Field of Search ..... 34/91, 202, 218, 34/219, 233, 225, 618, 619, 621, 622

[56] References Cited

U.S. PATENT DOCUMENTS

| | | | |
|---|---|---|---|
| 1,452,066 | 4/1923 | Cave | 34/622 |
| 2,680,522 | 6/1954 | Temple | 211/85 |
| 3,183,862 | 5/1965 | Melvin | 108/144 |
| 3,409,996 | 11/1968 | Konstandt | 34/91 |
| 4,578,881 | 4/1986 | Karlsson | 34/233 |
| 4,682,424 | 7/1987 | Irving | 34/233 |
| 4,978,013 | 12/1990 | Hogg | 211/181 |
| 5,394,619 | 3/1995 | Kaplan | 34/90 |
| 5,555,640 | 9/1996 | Ou | 34/202 |
| 5,666,743 | 9/1997 | Dawson | 34/219 |

FOREIGN PATENT DOCUMENTS

| | | | |
|---|---|---|---|
| 1588342 | 4/1970 | France | 34/622 |

*Primary Examiner*—Henry A. Bennett
*Assistant Examiner*—Pamela A. Wilson
*Attorney, Agent, or Firm*—Jacobson, Price, Holman & Stern, PLLC

[57] ABSTRACT

A portable clothes dryer has a rectangular cabinet for storing a blower fan at a rear portion of the cabinet and shelf inserts at a front portion of the cabinet. The cabinet has vertical slots located on the inside of the cabinet side panels for receiving and storing the shelf inserts. The cabinet further has a pair of front door panels having aligned horizontal slots that extend along the inside of the front door and side panels. The shelf inserts are fitted into the horizontal slots and clothing is placed on the shelf inserts. The blower fan then circulates air about the clothing placed on the shelf inserts. After the clothes are dry, the shelf inserts are removed from the horizontal slots and placed in the vertical slots. The front door panels may then be closed and the portable clothes dryer can be conveniently stored. Rollers are provided on the bottom of the cabinet to aid in movement of the dryer.

20 Claims, 3 Drawing Sheets

PORTABLE CLOTHES DRYER

BACKGROUND OF THE INVENTION

1. Field of the Invention

The present invention relates to a portable clothes drying device, especially for drying sweaters and the like which are susceptible to stretching or other distortion during drying operations. More particularly, the present invention relates to a portable clothes drying device for housing a conventional blower fan and a plurality of slidably engageable horizontal shelf inserts that support the clothing during the drying operation.

2. Description of the Related Art

The conventional clothes dryer is a large machine having a heat source, an internal rotating drum, and a door. Clothing is placed inside the rotating drum and the door is closed. The clothing is rotated and heated air is circulated about the clothes. The dampened air is directly vented to the outside of the house. The clothes dryer, however, is an expensive, bulky machine that must be permanently installed and requires a great deal of electricity and/or gas to operate.

Portable clothes dryers have been developed as alternatives to the clothes dryer machine. Also, clothes lines are commonly strung outdoors and clothing is hung on the line and affixed with a pin. Likewise, standing clothes drying racks have been utilized for hanging clothes both indoor and outdoor. However, these hanging lines or standing racks require a great deal of time for the clothes to dry thoroughly. Outdoor racks subject the clothes to inclement weather, insects and debris. Indoor racks, on the other hand, require a great deal of space and dampen the immediate air.

One type of indoor drying rack is shown in U.S. Pat. No. 5,394,619 to Kaplan, in which a foldable drying rack fits over a hot air floor duct. Clothing is hung on the rack and hot air is directed through ducts in the rack to the hanging clothing. The drying rack of Kaplan, however, is clearly limited to being used only over floor ducts. This requires the floor duct, as well as the surrounding area, to be free from furniture and other obstructions. In addition, vent coverings must be removed, which may be hazardous to children in the event the rack is knocked over. Also, the Kaplan rack interferes with the heating plan of the house, and cannot be used during non-heating months.

Another portable clothes dryer is shown in U.S. Pat. No. 3,409,996 to Konstandt. Konstandt hangs a heated blower to extend horizontally from a wall. A hanger rod runs parallel to the blower so that clothes can be hung on the hanger. The Konstandt apparatus, however, is not portable. In addition, the clothing must be hung, which results in stretching and deformity of clothes, particularly sweaters and the like.

SUMMARY OF THE INVENTION

Accordingly, it is a primary object of the present invention to provide a portable clothes dryer which will achieve a rapid drying of clothes, or apparel and can be readily converted from a compact storing condition to an expanded operating condition.

Another object of the present invention is to provide a portable clothes dryer that supports the clothes in a generally horizontal position during the drying operation and is therefore especially suitable for drying sweaters and the like which are susceptible to stretching and deforming during drying.

It is a further object of the present invention to provide a portable clothes dryer that is compact, simplistic in design, can be easily stored and moved, and which can be readily and economically manufactured and assembled from available components and materials.

In accordance with the foregoing objects, the present invention comprises a portable clothes dryer having a cabinet structure for storing a standard blower fan in a rear portion of the cabinet and shelf inserts in a front portion of the cabinet. The side panels of the cabinet have aligned vertical slots located on their inside surfaces for slidably receiving the shelf inserts therein for storage. The front of the cabinet preferably has a pair of front door panels which are normally closed for storage.

For the drying operation, the front door panels swing open to align each with one of the side panels. Substantially horizontal aligned slots extend along the inside of the front door and side panels. The shelf inserts are removed from their storage vertical slots and are slidingly fitted into the horizontal aligned slots, preferably starting with the lowermost slot. As each shelf insert is inserted in aligned horizontal slots, wet clothing is placed on the shelf insert. When a requisite number of inserts have been placed in position, with the clothes to be dried thereon, the blower fan is turned on to circulate air about the clothing placed on the shelf inserts.

After the clothes are dry, the shelf inserts are removed from the horizontal slots and replaced into the vertical slots. The front door panels may then be closed and the portable clothes dryer can be conveniently stored. Rollers are provided on the bottom of the cabinet to aid in movement of the dryer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
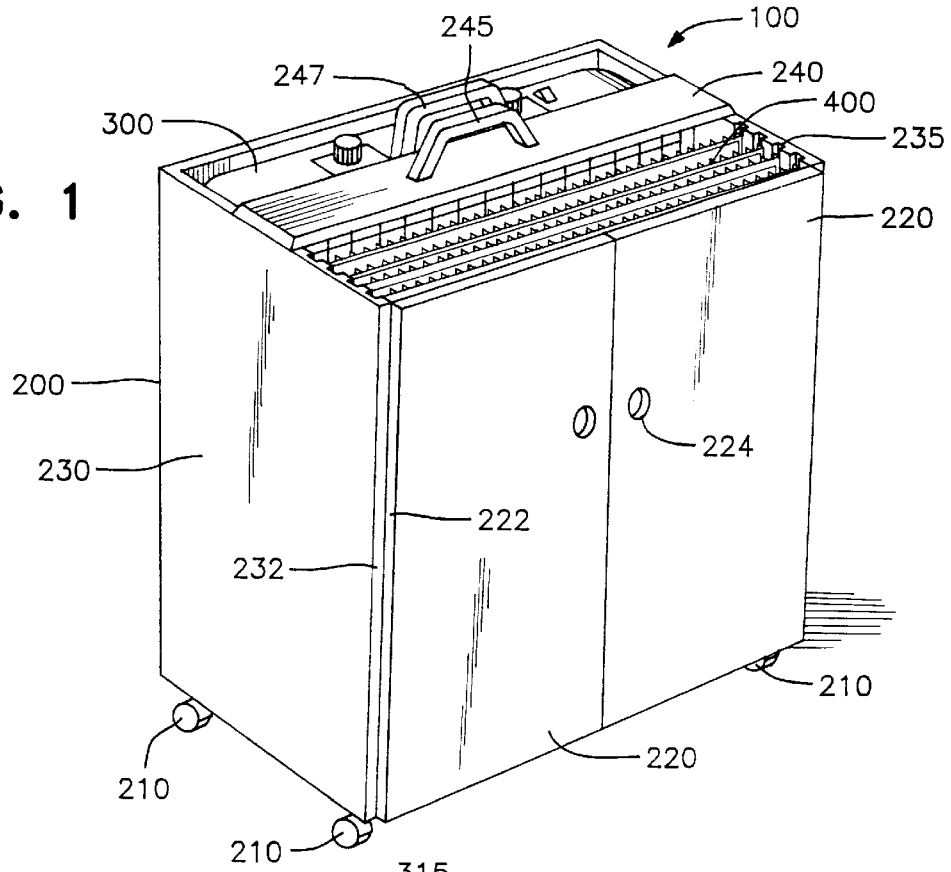
FIG. 1 shows a perspective view of the portable clothes dryer in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Now turning to the drawings, FIG. 1 shows a preferred portable clothes dryer 100 of the present invention. Dryer 100 essentially comprises a substantially rectangular housing or cabinet 200 with blower fan 300 of conventional construction and a series of shelf inserts 400 stored therein.

Cabinet 200 is preferably constructed of a rigid lightweight plastic material, although other materials such as wood, metal, etc. can also be used. The cabinet 200 preferably includes a pair of hinged solid front door panels 220, solid side panels 230, at least one elongated top brace member 240, and two rear brace members 250, 255. Mounted on the bottom 265 of the cabinet 200 are rollers or casters 210, preferably one in each corner. Front door panels 220 are fitted with a knob or a hole 224 so that the front door panels 220 may be easily opened.

In the preferred embodiment, cabinet 200 is constructed to store blower 300 in the rear portion of the cabinet 200 and shelf inserts 400 in the front portion of the cabinet 200. Front door panels 220 are connected to side panels 230 preferably by hinges 225. In a preferred size, the side panels 230 are about 12 inches wide and about 21½ inches high, and the front panels 220 are about 10¼ inches wide and about 21½ inches high. However, the cabinet 200 may be configured in a wide range of sizes, from desktop to large commercial items, and the preferred dimensions should not be construed as limiting. The shelf inserts are about 21 inches wide, about 21 inches long and about 5/16ths inch thick. A series of substantially vertical grooves or slots 235 are formed on the interior surface of each side panel 230 and in the front portion of cabinet 200. The vertical slots 235 are open at the top edge and extend substantially the entire inside height of each of the side panels 230. Each vertical slot 235 on one side panel 230 aligns with a corresponding vertical slot 235 on the opposite side panel 230.

As further shown in FIG. 1, cabinet 200 has four sets of vertical slots 235, which are preferably about ⅜ths inch deep, about 15 inches long and spaced about one inch apart. However, one of ordinary skill will recognize that any number of vertical slots 235 may be used at varying distances apart. The number and location of vertical slots 235 will depend upon the number and size of the shelf inserts 400. In addition, a locking tab (not shown) may be positioned over each vertical slot 235 to prevent the shelf inserts 400 from inadvertently falling out or being removed by children.

During storage of the dryer 100, the shelf inserts 400 are vertically fitted in the respective vertical slots 235 of side panels 230. Slots 235 serve to conveniently store the shelf inserts 400 in a compact arrangement with the blower 300 and also prevents the inserts from falling onto the blower 300 or falling out of the cabinet 200 when the front door panels 220 are opened.

A single elongated top brace member 240 preferably extends between the top edges of the two side panels 230 at the top of cabinet 200. The top brace 240 is narrow so as to allow air to enter and circulate through the dryer 100, especially when the blower 300 is in operation. A handle 245 is conveniently located centrally on the top brace 240 so that the dryer 100 may be easily lifted or moved. In addition, rollers or casters 210 are provided on the underside of cabinet 200 so that dryer 100 may be easily moved in conjunction with handle 245. Further, the height of side panels 230 and the position of top brace 240 are selected to prevent blower 300 from tipping forward by blocking movement of the blower handle 247. It should be recognized, however, that the blower 300 may optionally be configured to be integral with cabinet 200. Accordingly, the handle 245 is not a critical feature to the present invention. Likewise, the blower housing 305 may be integrated into the cabinet 200. For instance, the front and rear gratings 310 of the blower housing 305, as well as the fan 312 and control knobs 315, may be mounted directly to the cabinet 200. Also, the side panels of the blower housing may be discarded altogether.

Figure 2:
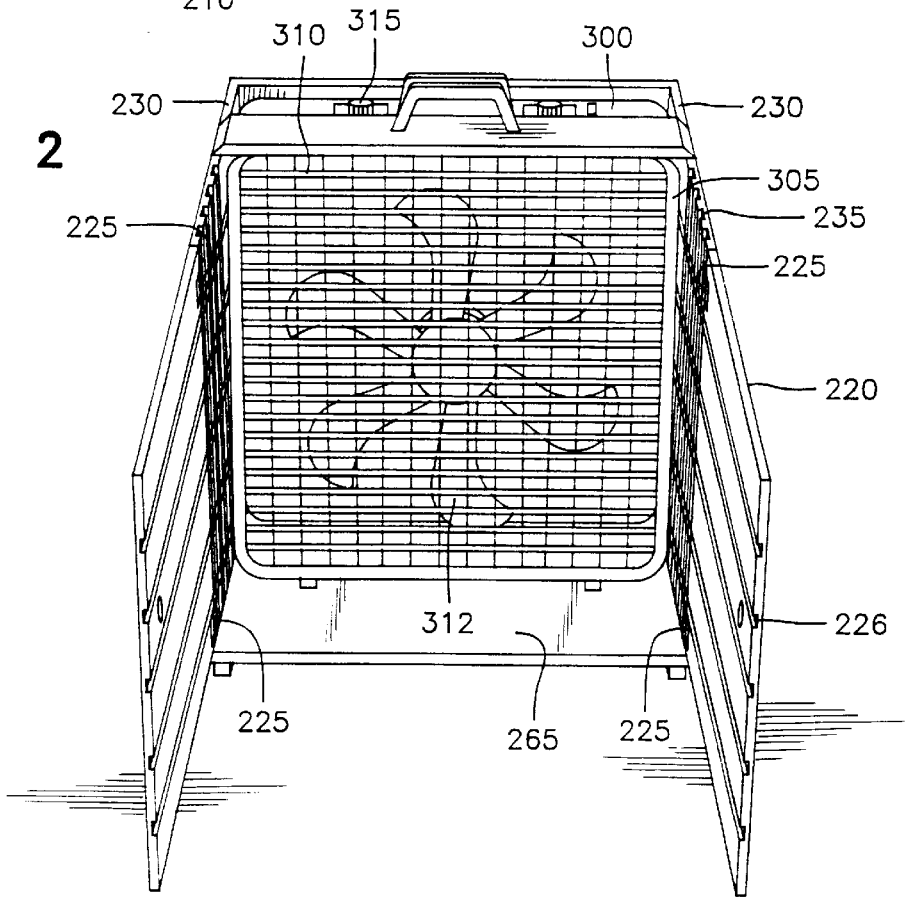
FIG. 2 shows a front perspective view of the portable clothes dryer in accordance with the present invention with the front door panels swung open and aligned with the cabinet side panels.

Now turning to FIG. 2, the clothes dryer 100 is shown with front door panels 220 in an open position. A plurality of substantially horizontal slots 226 extend along the entire width of each of the front door panels 220 and in registry along a substantial portion of the width of each side panel 230 in the front portion of cabinet 200. The horizontal slots 226 on each front door panel 220 and respective side panel 230 are configured to align with a corresponding horizontal slot on the opposite front door panel 220 and respective side panel 230. Thus, a portable clothes dryer cabinet is provided for drying clothes supported thereon in a substantially horizontal position by use of a conventional stand up vertical fan. The dryer has a rectangular compact housing having two side panels with a front portion and a rear portion and a pair of front door panels each connected to a front end of a respective side panel; a plurality of rectangular shelf inserts; a plurality of aligned vertical slots extending substantially the entire height of each side panel at said front portion of each side panel for removably engaging the shelf inserts; a plurality of aligned horizontal slots extending substantially the entire length of each front door panel and front end of each respective side panel for removably supporting the shelf inserts when the front door panels are opened such that clothing can be placed on the shelf inserts when the shelf inserts are supported on the horizontal slots; and the rear portion of the housing adapted to receive the fan such that when the fan is turned on the fan communicates air directly onto the clothing.

The dryer may further comprise rollers attached to the bottom of the housing to make the cabinet mobile. The housing may also include at least one elongated top brace member connected to a top end of each side panel and at least one elongated rear brace member connected to a rear edge of each side panel. The shelf inserts can be stored in the vertical slots when the cabinet is not in use. Each front door panel is connected to the front end of each respective side panel by a hinge and opens outwardly.

At least one narrow, elongated, rear brace member may be connected to a rear end of each of the side panels. At least one set of aligned horizontal slots in the side panels for removably engaging the at least one shelf insert with the front door panel open. The fan is a conventional standup vertical fan and the rear portion of said side panels and said cabinet are configured to receive said fan therein for circulating air to said clothing. The blower is a conventional standup vertical fan and the rear portion of the cabinet is configured to receive and support said fan therein in a position to communicate air to clothing supported on the at least one shelf insert.

In the preferred embodiment, blower fan 300 is any conventional upright vertical fan available from a number of manufacturers. For example, a conventional 16 inch fan is typical, having three speed settings and a directional setting. If desired, the blower may have a heater element to provide heated air to dry the clothes. The blower 300 aids the drying process by introducing new air to the clothing and forcing out dampened air. Alternatively, the blower may be set to move air in the opposite direction, i.e. to draw out the damp air while pulling in fresh air. The increase in air circulation increases the speed at which the clothes dry.

Also in the preferred embodiment, there are four sets of horizontal slots 226. The horizontal slots 226 are about ⅜ths inch deep, approximately 11 inches long and are positioned at about 3¼, 6¾, 10⅛, 13⅝ and 17 inches from the bottom 265 of the cabinet 200. However, one of ordinary skill will recognize that any number of horizontal slots 226 may be used at varying heights. The number and location of horizontal slots 226 will vary depending upon the size of the blower 300. The number of vertical slots 235 will preferably correspond with the number of horizontal slots 226.

Figure 3:
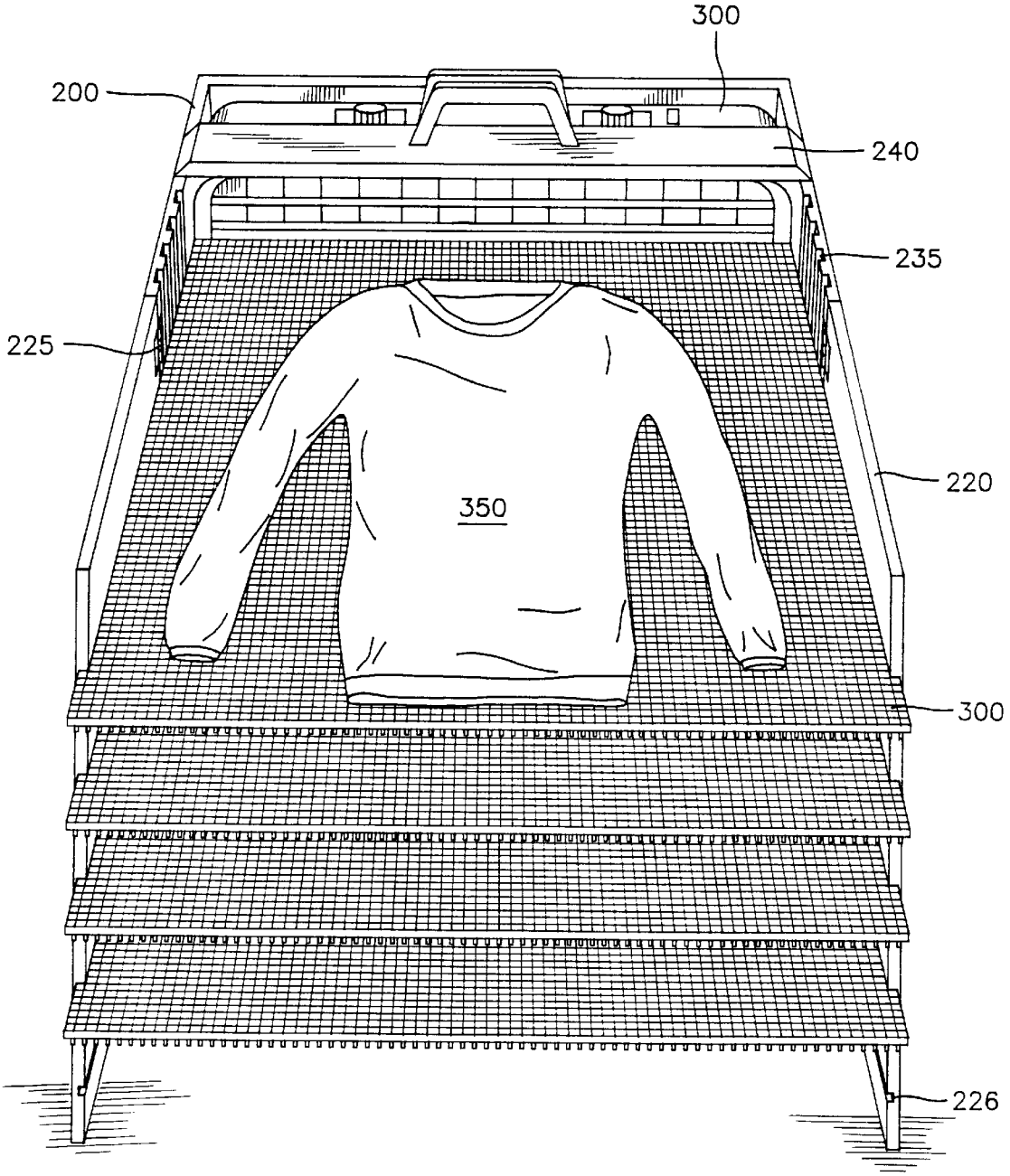
FIG. 3 shows a front perspective view of the portable clothes dryer in accordance with the present invention having the shelf inserts in place with a sweater shown on the uppermost shelf.

As shown in FIG. 3, when the front door panels 220 are fully opened, the front ends 232 of side panels 230 abut side edges 222 of front door panels 220, thus aligning their inside surfaces and horizontal slots 226 therein. Shelf inserts 400 may then be placed into the horizontal slots 226 of front door panels 220 and advance into the horizontal slots 226 of side panels 230. Shelf inserts 400 slide into the horizontal slots 226 from the front end of the front door panels 220 and extend preferably to be flush with the protective grate of blower 300.

FIG. 3 depicts a single shelf insert 400 being used for each set of horizontal slots 226. However, one of ordinary skill will recognize that each horizontal slot 226 may accommodate several smaller shelf inserts 400. In this regard, the shelf width may be varied in accordance with the size of the clothing to be dried, so long as the shelf length extends across between aligned horizontal slots 226.

In the preferred configuration, side panels 230 and front door panels 220 are solid thus presenting continuous and unbroken side surfaces to the shelf inserts 400 and clothing thereon. As such, the side panels 230 and front doors 220 direct air from blower 300 toward clothing 350 that might otherwise be focused away from the clothing 350. However, air vents may be placed along the side panels 230 and front door 220, if desired, to increase air circulation about the dryer 100.

As shown in FIG. 3, shelf inserts 400 overhang the end of front door panels 220. However, the shelf inserts 400 may alternatively be configured to be flush with the ends of front door panels 220 when open. In addition, a locking tab (not shown) may be positioned over the end of each horizontal slot 226 to prevent the shelf inserts 400 from becoming inadvertently dislodged. Further, suitable support attachments (not shown), such as pivoting door stops or the like, can be installed near the bottom corner of the door panels 220 to prevent the dryer from tipping forward when it becomes top heavy with clothing.

As further shown, shelf inserts 400 preferably comprise a plastic grating having a cross-hatch lattice pattern. The lattice pattern supports apparel or clothing article 350 and permits air to circulate about the clothing 350. In addition, the lattice pattern permits any water to drip from the sweater. A drip pan (not shown) may be provided for insertion on the lowermost horizontal slot 226 to accumulate any moisture dripping from the wet clothes.

The dryer 100 is particularly useful for sweaters and other hand washables such as dollies and hand-crafted items. Hanging articles such as wet sweaters and the like often cause the article to become stretched and distorted due to the weight of the liquid. By providing horizontal shelf inserts 400 the sweater or other article need not be hung. In addition, the lattice pattern of the shelf inserts 400 permits the sweaters and other articles to lay flat and dry rapidly.

Figure 4:
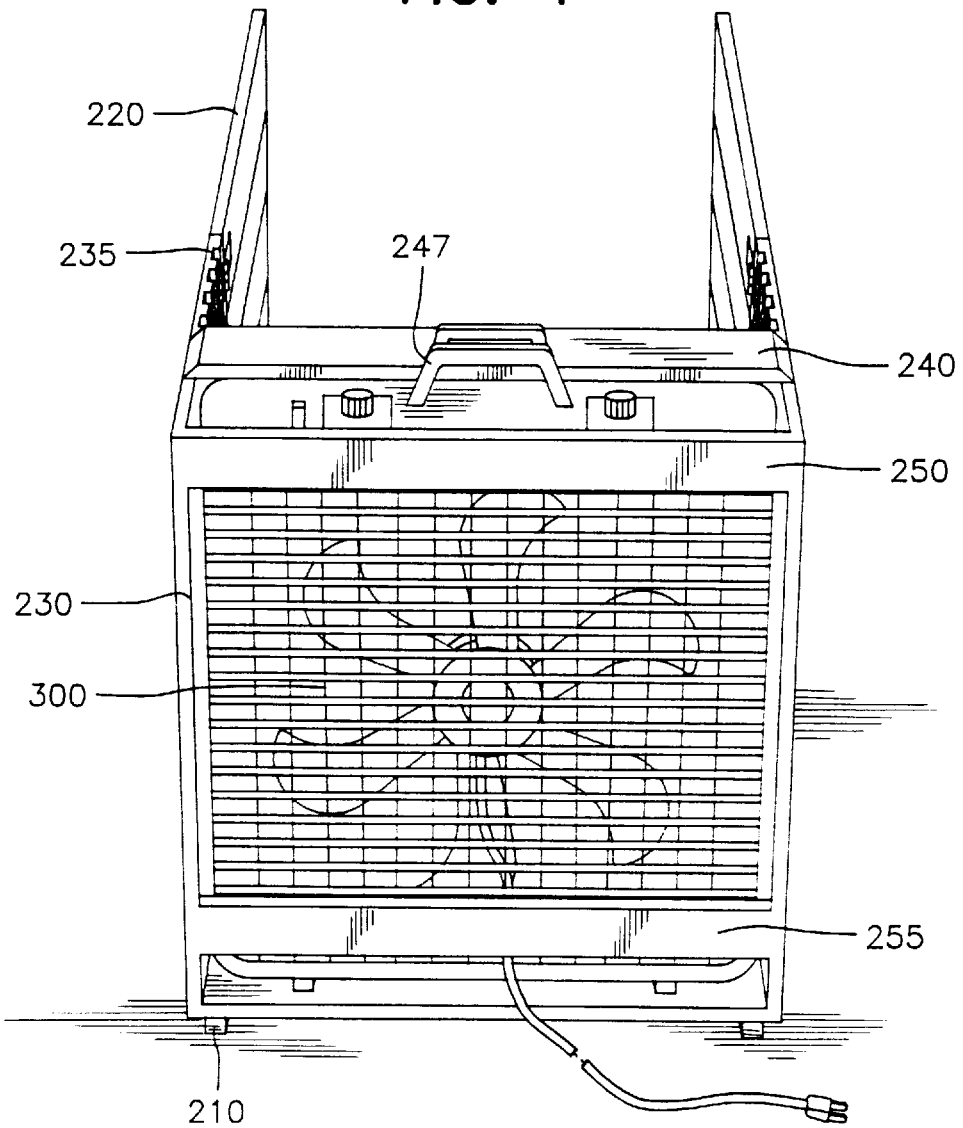
FIG. 4 shows a rear perspective view of the portable clothes dryer in accordance with the present invention.

A rear view of the cabinet 200 is shown in FIG. 4. Upper brace member 250 and lower brace member 255 extend between the two side panels 230. The brace members 250, 255 serve to rigidify the backs of side panels 230 and retain blower 300 within cabinet 200. As shown, it is preferred that the braces are narrow and elongated so that the back portion of the cabinet is mostly open to permit air to flow freely to (or from) blower 300. Upper brace member 250 is provided at the very top of cabinet 200 to maximize rigidity and minimize interference with air circulation.

Lower brace member 255 is spaced above the bottom of the cabinet 200 so that the electrical cord of blower 300 may be plugged in without interference by cabinet 200. A cleat or clasp (not shown) may be affixed to the cabinet 200 in order to take up excess length of the electrical cord of blower 300. The cleat may be positioned on either brace member 250, 255 or to the inside of a side panel 230.

In operation, the dryer 100 can be moved from storage to a convenient location for operation of the dryer. The doors 220 are then fully opened to provide a generally smooth surface between each front door panel 220 and its adjacent side panel 230 so as to align the horizontal slots 226 extending across the inside surfaces thereof. The stored shelf inserts 400 can then be easily removed from their vertical slots 235. Assuming several shelf inserts 400 will be utilized to support clothing during the drying operation, it is most convenient to install the insert shelves 400 starting with the lowermost supporting slots first. Appropriate clothing to be dried can then be placed thereon before the next shelf insert is slid into its supporting horizontal slots 226 and clothing laid thereon. In this manner, the dryer can be easily loaded irrespective of the spacing between the horizontal slots 226 and, therefore, between shelf inserts 400 when slid therein.

Once all the clothing to be dried has been placed on shelf inserts 400, properly slid into appropriate horizontal slots 226 and positioned thereon, the blower fan 300 can be turned on to communicate and circulate air to the clothes to be dried. When the drying operation is completed, it is most convenient to remove the clothes from each shelf insert sequentially, and remove that insert from its horizontal slots 226 before removing the clothing from the next lower shelf insert. However, this sequential operation is not necessary if there is sufficient spacing between shelf inserts when installed in the horizontal slots 226. Once all of the shelf inserts have been removed from the horizontal slots 226, they can be replaced in the vertical slots 235, the front door panels closed, and the unit returned to storage.

The foregoing descriptions and drawing should be considered as illustrative only of the principles of the invention. Numerous modifications and adaptations of the present invention will readily occur to those skilled in the art. For example, the brace member 240 is shown as permanently affixed to side panels 230. However, brace 240 may be hinged so that additional vertical slots 235 and shelf inserts may be provided in the area beneath the brace 240. In addition, although two front door panels 220 are used in the preferred embodiment, a single front door panel may be utilized. Alternatively, the front door panels 220 may be configured to slide into side panels 230.

Therefore, it is not desired to limit the invention to the specific embodiments disclosed or the exact construction and operation shown and described. Rather, all suitable modifications and equivalents may be resorted to, falling within the scope of the invention.

What is claimed:

1. A portable clothes dryer cabinet for drying clothes supported thereon in a substantially horizontal position by use of a conventional stand up vertical fan, which comprises:

a rectangular compact housing having two side panels with a front portion and a rear portion and a pair of front door panels each connected to a front end of a respective side panel;

a plurality of rectangular shelf inserts;

a plurality of aligned vertical slots extending substantially the entire height of each side panel at said front portion of each side panel for removably engaging said shelf inserts;

a plurality of aligned horizontal slots extending substantially the entire length of each front door panel and front end of each respective side panel for removably supporting said shelf inserts when said front door panels are opened such that clothing can be placed on said shelf inserts when said shelf inserts are supported on said horizontal slots; and said rear portion of said housing adapted to receive said fan such that when said fan is on, said fan communicates air directly onto said clothing.

2. The portable clothes dryer cabinet of claim 1, further comprising rollers attached to the bottom of said housing to make said cabinet mobile.

3. The portable clothes dryer cabinet of claim 1, wherein said housing also includes at least one elongated top brace member connected to a top end of each side panel and at least one elongated rear brace member connected to a rear edge of each side panel.

4. The portable clothes dryer cabinet of claim 1, wherein said shelf inserts have an open lattice design to facilitate air communication to said clothes.

5. The portable clothes dryer cabinet of claim 1, wherein said shelf inserts are stored in said vertical slots when the cabinet is not in use.

6. The portable clothes dryer cabinet of claim 1, wherein each front door panel is connected to the front end of each respective side panel by a hinge and opens outwardly.

7. A portable clothes dryer comprising a cabinet having two side panels with a front portion and a rear portion, at least one front door panel hingedly connected to a front end of one side panel, at least one narrow, elongated, rear brace member connected to a rear end of each said side panels, at least one shelf insert, at least one set of aligned vertical slots in the front portion of said side panels for receiving said at least one shelf insert for storage thereof with said door panel closed, at least one set of aligned horizontal slots in said side panels for removably engaging said at least one shelf insert with said front door panel open such that clothing can be placed on said at least one shelf insert, a fan located adjacent the rear portion of said side panels for circulating air to said clothing, and rollers attached to said cabinet to move the dryer.

8. The portable clothes dryer of claim 7, wherein a handle is attached to said elongated top panel to lift or move said dryer.

9. The portable clothes dryer of claim 7, wherein said shelf inserts include an open lattice design to facilitate air circulation around said clothing.

10. The portable clothes dryer of claim 7, wherein said front door panel is connected to the front end of a side panel by a hinge and opens outwardly.

11. The portable clothes dryer of claim 7, wherein said fan is a conventional standup vertical fan and the rear portion of said side panels and said cabinet are configured to receive said fan therein for circulating air to said clothing.

12. The portable clothes dryer of claim 7, wherein said fan is rigidly mounted into the rear portion of said cabinet.

13. The portable clothes dryer of claim 12 wherein said blower is a conventional standup vertical fan and the rear portion of said cabinet is configured to receive and support said fan therein in a position to communicate air to clothing supported on said at least one shelf insert.

14. The portable clothes dryer of claim 7, further comprising at least a second set of aligned horizontal slots on an inside of said at least one front door panel and aligning with said at least one set of aligned horizontal slots for removably engaging said at least one shelf insert with said front door panel open.

15. A portable clothes dryer comprising a cabinet having side panels, at least one front door connected to one of said side panels, a front portion and a rear portion, at least one shelf insert for supporting clothing, engaging means located in the front portion of said cabinet for removably supporting said at least one shelf insert with said front door open, a blower located in the rear portion of said cabinet for communicating air to clothing supported on said at least one shelf insert.

16. The portable clothes dryer of claim 15, wherein the front portion of said cabinet further comprises means for storing said at least one shelf insert.

17. The portable clothes dryer of claim 16, wherein said means of storing comprises at least one set of aligned vertical slots for removably supporting said at least one shelf insert in a substantially vertical position.

18. The portable clothes dryer of claim 15, wherein said engaging means comprises substantially aligned horizontal slots for removably supporting said at least one shelf insert.

19. The portable clothes dryer of claim 15, wherein said blower is rigidly mounted into the rear portion of said cabinet.

20. The portable clothes dryer of claim 15, further comprising at least a second set of aligned horizontal slots on an inside of said at least one front door panel and aligning with said at least one set of aligned horizontal slots for removably engaging said at least one shelf insert with said front door panel open.

* * * * *